US005348769A

United States Patent [19]

Gambale et al.

[11] Patent Number: 5,348,769

[45] Date of Patent: Sep. 20, 1994

[54] FLUOROSILICONE COMPOSITIONS AS WASH DURABLE SOIL AND STAIN REPELLENT FINISHES

[75] Inventors: Ronald J. Gambale, Croton-on-Hudson; Bruce C. J. Barbera, Wappinger Falls, both of N.Y.

[73] Assignee: OSi Specialties, Inc., Danbury, Conn.

[21] Appl. No.: 40,872

[22] Filed: Mar. 31, 1993

[51] Int. Cl.[5] ..... B05D 3/02

[52] U.S. Cl. ..... 427/387; 427/392; 427/393.4; 428/264; 428/266; 528/42

[58] Field of Search ..... 427/387, 392, 393.4; 528/42; 428/264, 266

[56] References Cited

U.S. PATENT DOCUMENTS

| | | | |
|---|---|---|---|
| 3,464,937 | 9/1969 | Bamford et al. | 260/18 |
| 3,597,457 | 8/1971 | Robinson et al. | 252/8.8 X |
| 3,859,320 | 1/1975 | Atherton | 260/448.2 |
| 4,036,868 | 7/1977 | Atherton | 260/448.2 |
| 4,355,171 | 10/1982 | de Montigny et al. | 556/446 |
| 4,417,024 | 11/1983 | Koda et al. | 524/726 X |
| 4,465,805 | 8/1984 | Blizzard et al. | 524/765 |
| 4,497,962 | 2/1985 | de Montigny et al. | 556/446 |
| 4,549,003 | 10/1985 | Lim et al. | 528/42 |
| 4,562,223 | 12/1985 | Steinberger et al. | 524/506 |
| 4,574,149 | 3/1986 | Lee et al. | 528/42 |
| 4,642,356 | 2/1987 | Langner et al. | 549/214 |
| 4,657,959 | 4/1987 | Bryan et al. | 524/266 |
| 4,704,408 | 11/1987 | Krug et al. | 521/82 |
| 4,812,364 | 3/1989 | Alberts et al. | 428/447 |
| 5,209,965 | 5/1993 | Caldwell | 427/387 X |

FOREIGN PATENT DOCUMENTS

| | | |
|---|---|---|
| 225585 | 9/1990 | Japan . |
| 1140072 | 1/1969 | United Kingdom . |
| 2017774 | 12/1978 | United Kingdom . |
| 2074181 | 4/1981 | United Kingdom . |

OTHER PUBLICATIONS

Tanaka, Masahide and Masahiro Kuwabara, "Fluoro hydroxy silicones and derivatives", *CA Selects: Organosilicon Chemistry,* Issue 16, 1991, p. 26.

*Primary Examiner*—Michael Lusignan

[57] ABSTRACT

This invention provides a method of using perfluoroalkyl hydroxyalkyl siloxanes to impart wash durable soil and stain repellency to a fibrous substrate such as cotton and cotton/polyester fabric.

9 Claims, No Drawings

FLUOROSILICONE COMPOSITIONS AS WASH DURABLE SOIL AND STAIN REPELLENT FINISHES

FIELD OF THE INVENTION

The present invention relates to fluorosilicone compositions and a method of using them. More particularly, the present invention relates to perfluoroalkyl hydroxyalkyl siloxanes, and a method of using them to impart wash durable soil and stain repellency to textiles, especially to cotton and cotton/polyester fabric.

BACKGROUND OF THE INVENTION

Many fabrics, such as cotton/polyester blends, are well known for their combination of durability and wearability. Such fabrics have been commercially treated with stain and soil repellant finishes such as fluorochemical finishes. These fluorochemical finishes are fluorinated polymers, including esters or amides of polyacrylic acids, and are sold as emulsions or dispersions for addition to aqueous pad baths. While these products impart good resistance to soiling and staining, these products are easily removed after several launderings in water or by dry cleaning. Garments treated with these fluorochemical finishes are subject to premature disposal, since once the finish is depleted on the garment, the garment is usually discarded. Hence, there is a need to provide a fabric finish which provides stain and soil repellency and is also capable of withstanding numerous washings in water or dry cleanings.

SUMMARY OF THE INVENTION

The present invention provides a method for imparting wash durable soil and stain repellency to a fibrous substrate, which method comprises contacting a fibrous substrate with a durable press resin, catalyst, and a perfluoroalkyl hydroxyalkyl siloxane selected from the group consisting of (i) linear siloxanes having the general formula:

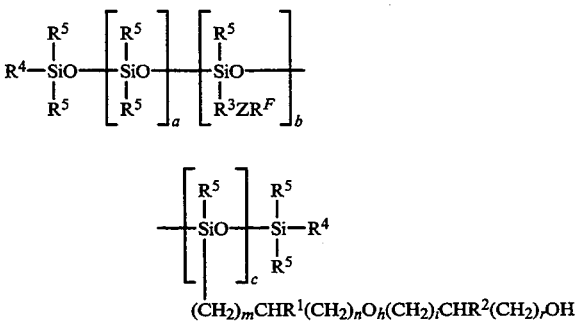

wherein a=0 to 100;

b=1 to 100;

c=1 to 100; and (ii) cyclic siloxanes having the general formula:

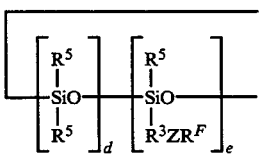

-continued

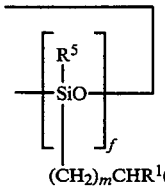

wherein d=0 to 10;

e=1 to 10;

f=1 to 10;

with the proviso that d+e+f is greater than or equal to 3; and wherein in both formulae:

each $R^1$ and $R^2$ is selected from the group consisting of hydrogen, hydroxy, and an alkyl group having 1 to 6 carbon atoms;

$R^3$ is selected from the group consisting of $(CH_2)_y$-CHOHCHR$^2$ and $(CH_2)_gQ_i$ wherein Q is selected from the group consisting of —NH—, —S—, and —O—; i is 0 or 1;

y is 2 to 4; and g is 1 to 6;

$R^4$ is selected from the group consisting of $CH_3$, $(CH_2)_mCHR^1(CH_2)_nO_h(CH_2)_iCHR^2(CH_2)_rOH$, and $R^3ZR^F$;

Z is selected from the group consisting of —NH-CO—; —$NHSO_2$—, —$O_2C$—, —$O_3S$—, —$OCH_2CH_2$—, —$NHCH_2CH_2$—, and —$CH_2$-$CHOHCH_2$—;

h is 0 or 1;

i is 0 to 6;

r is 0 to 4;

m is 1 to 6;

n is 0 to 6;

$R^F$ is a perfluoro alkyl group, $C_pF_{2p+1}$, wherein p is 1 to 20; and each $R^5$ is independently selected from the group consisting of a methyl group, an ethyl group, and a phenyl group.

DETAILED DESCRIPTION OF THE INVENTION

By "wash durable" is meant the ability of the fibrous substrate to retain nominal oil repellency after repeated washing and drying cycles. Nominal oil repellency is considered an oil repellency rating 3 or higher (AATCC Standard Test Method 118-1983). Desirably, nominal oil repellency is retained for a minimum of 10 washing and drying cycles, and preferably for 20 or more washing and drying cycles.

Perfluoroalkyl Hydroxyalkyl Siloxane

It is understood that the linear and cyclic siloxanes herein can be random or blocked, and typically they are random. For the linear siloxanes, preferably a is 0; b is 1 to 20; c is 1 to 20; $R^3$ is $(CH_2)_3$; Z is —$NHSO_2$—; $R^F$ is $C_8F_{17}$; m is 1; each $R^1$, $R^4$, and $R^5$ is a methyl group; n is 0; $R^2$ is a hydrogen; r is 0; h is 0, and i is 0. Most preferably in the linear siloxanes, a is 0; b is 1 to 10; c is 1 to 5; $R^3$ is $(CH_2)_3$; Z is—$NHSO_2$—; $R^F$ is $C_8F_{17}$; each $R^1$, $R^4$, and $R^5$ is a methyl group; m is 1; n is 0; $R^2$ is a hydrogen; r is 0; h is 0; and i is 0.

For the cyclic siloxanes, preferably d is 0; e is 1 to 5; f is 1 to 5; e+f is 3 to 6; $R^3$ is $(CH_2)_3$; Z is —$NHSO_2$—; $R^F$ is $C_8F_{17}$; m is 1; each $R^1$ and $R^5$ is a methyl group; n is 0; $R^2$ is a hydrogen; and r is 0; h is 0; and i is 0. Most preferably in the cyclic siloxanes, d is 0; e is 1 to 3; f is 1 to 3; e+f is 4 or 5; $R^3$ is $(CH_2)_3$; Z is $—NHSO_2—$; $R^F$ is $C_8F_{17}$; m is 1; each $R^1$ and $R^5$ is a methyl group; n is 0; $R^2$ is a hydrogen; and r is 0; h is 0; and i is 0.

Preparation of the Perfluoroalkyl Hydroxyalkyl Siloxane

The perfluoroalkyl hydroxyalkyl siloxanes of the present invention are prepared by hydrosilating an Si—H containing siloxane with a perfluoroalkyl-functional olefin and a hydroxyalkyl olefin. Perfluoroalkyl-functional olefins are olefins that are substituted, optionally through intervening groups, with perfluoroalkyl groups. Perfluoroalkyl-functional olefins can be prepared, for example, according to the following reaction process (Process A).

Process A

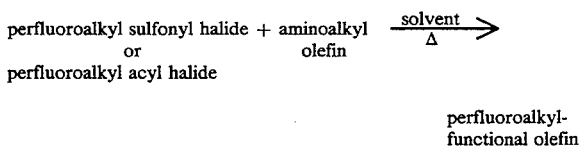

In general, the perfluoroalkyl-hydroxyalkyl siloxanes of the present invention are prepared in accordance with the following reaction process (Process B).

Process B

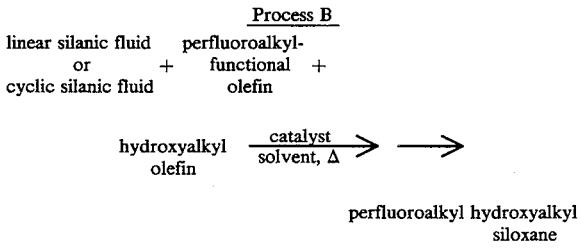

In Process A, the molar ratio of the aminoalkyl olefin to the perfluoroalkyl sulfonyl halide or the perfluoroalkyl acyl halide is at least 2 to 1 and preferably is 3 to 1. The solvent in Process A is a linear, branched or cyclic ether having 4 to 12 carbon atoms and is preferably isopropyl ether. The temperature in Process A ranges from 30° C. to 50° C. and is preferably 35° C. to 45° C. Generally, Process A is conducted at ambient pressure in an inert atmosphere such as, for example, nitrogen or argon.

The perfluoroalkyl sulfonyl halide (i.e., Cl, Br, I, F) of Process A can be perfluoro-1-octane-sulfonyl fluoride available from 3M Corporation. Other perfluoroalkyl sulfonyl halides can be prepared in accordance with the disclosure in U.S. Pat. No. 2,712,398. In Process A, the perfluoroalkyl acyl halide can be nonadecafluoro-1-decanoylchloride as set forth in Example 2 herein. Other perfluoro acyl halides can be prepared in accordance with the disclosure in *Org. Synt.* (1932), *Coll, Vol.* 1, 12, F. K. Thayer; *J. Amer. Chem. Soc.* (1920), 42, 599, R. Adams, L. H. Ulich; *Can. J. Chem.* (1955), 33, 1515; and *J. Chem. Soc.* (1963), 491, E. G. Brain et al.

The aminoalkyl olefins of Process A are well known and can be, for example, allylamine or methallyl amine. Aminoalkyl olefins are commercially available such as, for example, from Eastman Kodak Co., Fisher Scientific Company, Hoechst Celanese, and Polyscience, Inc. among others.

In Process B, the catalyst can be any known hydrosilation catalyst such as chlorides of rhodium, platinum and ruthenium and, preferably, is chloroplatinic acid. The solvent of Process B can be any solvent known for use in hydrosilation reactions such as, for example, toluene and isopropanol, and preferably is toluene. Optionally, Process B can be conducted without a solvent. The temperature for Process B can range from 80° C. to 100° C., and preferably is 85° C. to 95° C.

The linear silanic fluid of Process B is readily commercially available from Union Carbide Chemicals and Plastics Company Inc. Alternatively, it can be prepared in accordance with procedures set forth in U.S. Pat. No. 4,661,405. Illustrative linear silanic fluids for use in the present invention can include, for example, Union Carbide ® L-31.

The cyclic silanic fluid of Process B is readily commercially available from Petrarch Systems, Inc. of Hüls America Inc. and Pfaltz & Bauer, Inc. Illustrative cyclic silanic fluids can include, for example, 1,3,5,7-tetramethylcyclotetrasiloxane and pentamethylcyclopentasiloxane.

The hydroxyalkyl olefins of Process B are well known and can be, for example, allyl alcohol and methallyl alcohol. Hydroxyalkyl olefins are readily commercially available from Eastman Kodak Company, Fisher Scientific Company, Polyscience, Inc., Pfaltz & Bauer, Inc. and Aldrich Chemical Company among others.

Durable Press Resin

Any durable press resin known to those skilled in the fabric treatment art can be employed in the method of the present invention. Durable press resins and methods of using them are described in U.S. Pat. Nos. 3,909,199 and 3,970,424. In general, durable press resins useful in the present invention have a

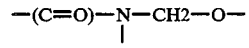

moiety. Preferred durable press resins useful in the present invention are aqueous formulations containing a cellulose crosslinking agent, such as an N-methylol amide crosslinking agent or a dialkyldihydroxyethyleneurea. N-methylol amide crosslinking agents have the generalized structure:

$$R(C{=}O)—NR'—CH_2X$$

wherein X represents a leaving group such as —OH or $—OCH_3$, or $—OCH_2CH_2OH$; R can be an alkyl, aryl, ether, or a substituted amino group, and R′ can be a hydrogen, an alkyl group, or an aryl group. Carbon atoms in R and R′ can be substituted, such as with hydroxyl groups, and can be connected to each other, such as by a chemical bond or an alkyl chain, to form a cyclic structure. Suitable N-methylol amide crosslinking agents include N,N-dimethylol-4,5-dihydroxyethyleneurea (DMDHEU), 1,3-bis-(methoxymethyl)-4,5-dihydroxy-2-imidazolidinone (Me-DMDHEU), 1,3-dimethylolethyleneurea (DMEU), and dimethylol isopropyl carbamate (DMIPC). Suitable dialkyldihydroxyethyleneurea durable press resins include 1,3-dimethyl-4,5-dihydroxy-2-imidazolidinone. Especially preferred durable press resins are DMDHEU and Me- DMDHEU. The concentration of the durable press resin may vary in weight percent of the total pad bath formulation weight from about 5 percent to 25 percent, with the preferred range being from about 8 percent to 16 percent.

Organic Solvent

Optionally, an organic solvent can be employed in the present invention. Organic solvents which can be employed in the present invention can include lower molecular weight alcohols having 1 to 5 carbon atoms such as, for example, methanol, ethanol, n-propanol, isopropanol, n-butanol, t-butanol, and n-amyl alcohol. Preferred alcohol for use in the present invention include methanol, ethanol, and isopropanol. Ketones having 1 to 6 carbon atoms can also be employed in the present invention as the organic solvent. These include, for example, acetone, 2-butanone and 2-pentanone. A preferred ketone for use in the present invention is acetone. Polyalkylene glycols and glycol ethers can also be used as organic solvents in the present invention. Preferred polyalkylene glycols and glycol ethers include those having the formula, $RO(CH_2CHR'O)_nR''$, in which n ranges from 1 to 10, R' is selected from the group consisting of hydrogen and a methyl group, and each R and R' is independently selected from the group consisting of hydrogen, an alkyl having 1 to 4 carbon atoms, and an aryl having 6 to 8 carbon atoms.

When employed the amount of organic solvent ranges from about 1 to 50 weight percent based upon the total pad bath formulation weight. Preferably, the amount of organic solvent ranges from about 1 to 20 weight percent based upon the total pad bath formulation weight.

Catalyst

The perfluoroalkyl hydroxyalkyl siloxane of the present invention can be used in the presence of a catalyst. Preferred catalysts are acidic and are Bronsted or Lewis acids capable of catalyzing the reaction of the siloxane with the substrate. Suitable acid catalysts include, for example, p-toluenesulfonic acid, zinc chloride, zinc tetrafluoroborate, aluminum chloride, magnesium chloride, aluminum chlorohydroxide and mixtures thereof. In a preferred embodiment, the catalyst is an aqueous solution of magnesium chloride. The amount of the catalyst ranges from about 0.5 to 10 percent by weight based upon the weight of the fabric, preferably the amount of catalyst ranges from about 2 to 5 percent by weight based upon the weight of the fabric.

Method of Using the Perfluoroalkyl Hydroxyalkyl Siloxane

The perfluoroalkyl hydroxyalkyl siloxane of the present invention can be diluted with water to a desired solids level and applied onto a fiber substrate using any suitable means, such as, for example, spraying, dipping or kiss roll application. Indeed, it will be more common to prepare a concentrate at a higher solids content in order to reduce shipping and/or handling costs and then dilute the concentrate with water just prior to use. The content of the perfluoroalkyl hydroxyalkyl siloxane of the present invention in the final emulsion which is applied to the fabric ranges from about 0.25 to 20 percent, preferably about 0.25 to 5 percent, and most preferably is about 0.25 to 2.5 percent by weight based upon the total weight of the emulsion. After the textile is dried either at room temperature or by heating, it is cured at a temperature less than the melting or decomposition temperature of the textile. Heating can be accomplished by any suitable means known in the art, however, preferably heating is accomplished by passing the textile through a hot air oven. The textile so treated has properties such as stain and soil repellency and with good wash durability during laundering and dry cleaning.

Fibrous Substrate

The fibrous substrate employed in the present invention is exemplified by natural fibers such as cotton, flax, silk, and wool; synthetic fibers such as polyester, polyamide, polyacrylonitrile, polyethylene, polypropylene, and polyurethane; and mixtures and blends thereof. Preferably, the fibrous substrate employed in the present invention is a natural fiber. Most preferably, the fibrous substrate employed in the present invention is a natural fiber and blends thereof, such as for example, cotton and cotton/polyester blends.

Whereas the exact scope of the instant invention is set forth in the appended claims, the following specific examples illustrate certain aspects of the present invention and, more particularly, point out methods of evaluating the same. However, the examples are set forth for illustration only and are not to be construed as limitations on the present invention except as set forth in the appended claims. All parts and percentages are by weight unless other specified.

EXPERIMENTAL

Examples 1 through 3 provide intermediates for the perfluoroalkyl hydroxyalkyl siloxane prepared in Example 4. The chemical compositions of the perfluoroalkyl hydroxyalkyl siloxanes of Example 4 are set forth in Table 1. Example 5 describes treating fabric with the perfluoroalkyl hydroxyalkyl siloxane of the present invention. Examples 6 and 7 set forth the testing procedure employed to demonstrate stain and soil repellency and wash durability for laundering and simulated dry cleaning, respectively. The results are contained in Tables 2 and 3. The compositions of the controls employed in the Tables 2 and 3 are as follows:

Control A a fluorochemical polymer 30–40% aqueous emulsion commercially available as DuPont Zonyl® 6700

Control B a fluorochemical polymer 30–40% aqueous emulsion commercially available as Sandofluor® GPC liquid from Sandoz Chemical Company

EXAMPLE 1

Preparation of N-allyl perfluoro-1-octanesulfonamide

Allyl amine (45.0 milliliters, 3.0 molar equivalent) and isopropyl ether (200.0 milliliters) were charged into a 3-neck 500-milliliter round bottom flask equipped with a Claisen joint adapter, dropping funnel and overhead mechanical stirrer at room temperature under a nitrogen blanket. The Claisen joint adapter was attached to a Thermowatch® thermometer adapter and water cooled condenser (to the nitrogen inlet). The mixture was warmed to 25° C. with stirring. Perfluoro-1-octanesulfonyl fluoride (100.0 grams, 1.0 molar equivalent, Aldrich Chemical Co.) was added by the dropping funnel over 1.5 hours. The reaction mixture was maintained at about 25° C. by immersing the reaction flask in a room temperature water bath. After the addition was completed, the reaction mixture was heated for 2 hours at 30° C., followed by 2 hours at 40° C. Upon cooling to 30° C. using a water bath, 120 milliliters of a 9% aqueous hydrochloric acid solution was added over 15 minutes while maintaining the temperature at 25° C. After separation of the layers in a separatory funnel, the organic layer was washed with an aqueous 4.5% hydrochloric acid 4.0% ferrous sulfate solution. The organic phase was isolated and evaporated in vacuo, further dried under vacuum (0.1 millimeters Hg) in a water bath at 70° C. for 0.5 hours to give a red pasty solid. The crude reaction product was subjected to high vacuum distillation to give a slightly yellow solid (boiling point 98° C.) (0.1 millimeters Hg)(85.62 grams, 80% purified yield).

EXAMPLE 2

Preparation of Nonadecafluoro-1-decanoyl chloride

Nondecafluorodecanoic acid (20.00 grams, 1.0 molar equivalent, Aldrich Chemical Co.), sodium methoxide (2.20 grams, 1.05 molar equivalent) and methanol (140.0 milliliters) were charged to a 500-milliliter round bottom flask at room temperature under a nitrogen blanket. After stirring at room temperature for 3.5 hours, the reaction mixture was evaporated in vacuo, dried under high vacuum (0.1 millimeters Hg) in a 60° C. oven for 5 hours to give a white solid (17.70 grams) as the carboxylic acid sodium salt. This crude dried salt and isopropyl ether (140.0 milliliters) were charged into a 500-milliliter round bottom flask at room temperature under a nitrogen blanket. Oxalyl chloride (9.02 milliliters, 3.0 molar equivalent) was added by a dropping funnel over 15 minutes at room temperature. The mixture was heated at 50° C. for 5 hours, cooled to room temperature and filtered through a sintered glass funnel. The filtrate was evaporated in vacuo to give 14.27 grams (69% isolated yield over two steps) of a colorless clear oil which was stored cold under argon overnight and used promptly the next day.

EXAMPLE 3

Preparation of N-allyl nonadecafluoro-1-decanamide

Allyl amine (6.03 milliliters, 3.0 molar equivalent) and isopropyl ether (35.0 milliliters) were added to a 3-neck 100-milliliter round bottom flask equipped with water cooled condenser (to a nitrogen inlet), dropping funnel and thermometer adapter (to a Thermowatch device) at room temperature under a nitrogen blanket. A solution of nonadecafluoro-1-decanoyl chloride (14.27 grams, 1.0 molar equivalent) in 5.0 milliliters isopropyl ether was added by the dropping funnel over 2 hours while maintaining the temperature below 30° C. After the addition was completed, the reaction mixture was heated for 2 hours at 30° C., followed by additional treating for 2 hours at 40° C. After cooling the mixture to room temperature, the mixture was diluted with 100 milliliters isopropyl ether and washed with 9% aqueous hydrochloric acid solution (75 milliliters). The aqueous layer was extracted with 50 milliliters isopropyl ether. The combined organic layers were evaporated in vacuo to give a red solid. High vacuum distillation produced 13.03 grams (88% isolated yield) of a light yellow solid (boiling point 100° C., 0.1 millimeters Hg).

EXAMPLE 4

Procedure for the Preparation of Perfluoroalkyl Hydroxyalky Siloxanes by Hydrosilylation of Silanic Fluids The following procedure was employed for all the examples noted in the Tables. The perfluoroalkyl functional olefin in the molar ratio set forth in Table 1 and toluene (weight equivalent to perfluoroalkyl functional olefin) were charged into a 3-neck round bottom flask equipped with a dropping funnel, water-cooled condenser (to a nitrogen inlet) and thermometer adapter (to a Thermowatch device) and heated to 90° C. under a nitrogen blanket. Approximately 10% of the silanic fluid in the molar ratios set forth in Table 1 was added by the dropping funnel. Hexachloroplatinic acid, 12.5 ppm, (as 10 milligrams Pt/milliliter ethanolic solution, based on total reagents weight) was added by syringe, and the mixture was allowed to exotherm no hotter than 100° C. Approximately two-thirds of the silanic fluid was added by the dropping funnel over 15 minutes while maintaining the temperature below 100° C. An additional 12.5 ppm hexachloroplatinic acid was added, followed by the remainder of the silanic fluid over 15 minutes. After stirring at 90° C. under a nitrogen blanket for 3.0 hours, the hydroxyalkyl olefin in the molar ratio set forth in Table 1 was added by the dropping funnel over 0.5 hours while maintaining the temperature below 100° C. After stirring at 90° C. for 1.0 hours, an aliquot of the reaction mixture was withdrawn for evaluation of residual Si—H content by observing hydrogen gas evolution when treated with ethanolic potassium hydroxide. If any hydrogen evolution were noted, an additional 10 to 15 ppm hexachloroplatinic acid was added and the mixture was stirred at 90° C. for an additional 1.0 hours. A 30% molar excess of the hydroxyalkyl olefin was added by the dropping funnel over 15 minutes, the mixture was stirred at 90° C. for 0.5 hours. After cooling to approximately 40° C., sodium bicarbonate (2.5% wt % based on total reagents weight) was added, and the mixture was stirred at room temperature for 1 hour. The mixture was diluted with twice the volume of 1,1,2-trichlorotrifluoroethane, pressure filtered through a medium porosity polypropylene filter pad, evaporated in vacuo and dried under high vacuum (0.1 millimeters Hg) at 70° C. for 1 hour to give the perfluoroalkyl hydroxyalkyl siloxanes as light yellow solids.

EXAMPLE 5

Application of Perfluoroalkyl Hydroxyalkyl Siloxane to 35/65 Cotton/Polyester Fabric

Procedure—One Step Pad Bath

A specific siloxane as set forth in Table 1 (1.0 gram) was dissolved in a solvent (20.0 grams of acetone, ethanol or isopropanol as noted in Table 1 ). The solvent solution was added to a mixture of deionized water (20.0 grams), Intex 510 resin solution (7.5 grams of a 35% aqueous solution of dimethyloldihydroxyethylurea) and Intex catalyst 58 solution ( 1.2 grams of a 65% aqueous solution of magnesium chloride) with rapid stirring for 1 minute. This pad bath mixture was charged as quickly as possible into a V-shaped metal dipping trough, and a 16.5 cm×35.5 cm 35/65 cotton/polyester fabric swatch (205 grams/$m^2$ density) was immersed completely into the trough, removed and wrung through a roll press operating at 0.5 bar air pressure. The treated fabric was immediately cured in a forced air evaporating oven at 170° C. for 3 minutes, removed and cooled to room temperature.

*Alternate Procedure

Some of the siloxane pad baths appeared to have insoluble materials present during fabric treatment. A modification of the above procedure to partially alleviate this problem follows. The specific siloxane as set forth in Table 1 (1.0 gram) and Intex catalyst 58 solution (1.2 grams of a 65% aqueous solution of magnesium chloride) were dissolved in 15.0 grams solvent. This solvent solution was added to a mixture of deionized water (20.0 grams), Intex® 510 resin solution (7.5 grams) and solvent (5.0 grams) with rapid stirring for 1 minute. This pad bath mixture was applied to the test fabric exactly as described above under the same curing conditions.

Two Step Pad Bath Procedure

A mixture of deionized water (41.5 grams), Intex® 510 resin solution (7.5 grams of a 35% aqueous solution of dimethyloldihydroxyethylurea) and Intex® catalyst 58 solution (1.2 grams of a 65% aqueous solution of magnesium chloride) was charged as quickly as possible into a V-shaped metal dipping trough. A 16.5 cm×35.5 cm 35/65 cotton/polyester fabric swatch (205 grams/$m^2$ density) was immersed completely into the trough, removed and wrung through a roll press operating at 0.5 bar air pressure. The treated fabric was immediately cured in a forced air evaporating oven at 170° C. for 30 seconds, and removed briefly. A solution of a specific siloxane as set forth in Table 1 (1.0 gram) in 1,1,2-trichlorotrifluoroethane (49.0 grams) was added to the V-shaped metal dipping trough. Standard cotton/polyester fabric was immersed and wrung exactly as described above. The treated fabric was immediately cured in a forced air evaporating oven at 170° C. for 3 minutes, removed and cooled to room temperature.

EXAMPLE 6

Procedure for Oil Repellency Testing of Treated Cotton/Polyester Fabrics

A standard swatch of cotton/polyester fabric treated with the finish as described in either procedure above was tested for oil repellency in accordance with AATCC: Hydrocarbon Resistance Method #118-1983. The treated fabric was laundered (using AATCC standard detergent in water heated to 120° F. using a normal washing cycle), tumble dried (using a standard 40-minute dryer cycle). The swatches were evaluated for oil repellency for the number of washes indicated in Table 2.

EXAMPLE 7

Procedure for Simulated Dry Cleaning of Treated Cotton/Polyester Fabrics

A standard swatch of cotton/polyester fabric treated with finish as described in either procedure above was placed in a 1-liter polypropylene container with 300 milliliters 1,1,2-tri-chlorotrifluoroethane (or tetrachloroethylene) and ceramic balls and tumble milled for 30 minutes at room temperature. After air drying, the fabric was tested for oil repellency in accordance with AATCC: Hydrocarbon Resistance Method #118-1983. This process was repeated until an unacceptable oil rating value was observed.

TABLE 1

Description of Perfluoroalkyl Hydroxyalkyl Silicones and Controls in the Examples

| Silicone No. | Structure | Solvent Used |
|---|---|---|
| 1 | $MD^{**}_3D''_2M$ | 40% aq. acetone |
| 2 | $MD^{**}_4D''_1M$ | 40% aq. acetone |
| 3 | $MD^{**}_{4.5}D''_3M$ | 40% aq. acetone |
| 4 | $MD^{**}_{7.5}D''_{7.5}M$ | 40% aq. acetone |
| 5 | $MD^{**}_9D''6M$ | 40% aq. acetone |
| 6 | $MD^{**}_{10.5}D''_{4.5}M$ | 40% aq. acetone |
| 7 | $MD^{**}_{15}D''_{10}M$ | 40% aq. acetone |
| 8 | $M^*D^*_3D''_2M^*$ | 40% aq. acetone |
| 9 | $M^*D^*_{3.7}D''_{3.8}M^*$ | 40% aq. acetone |
| 10 | $M^*D^*_{5.2}D''_{4.8}M^*$ | 40% aq. ethanol |
| 11 | $M^*D^*_{6.5}D''_{3.5}M^*$ | 40% aq. acetone |
| 12 | $M^*D^*_8D''_2M^*$ | 40% aq. acetone |
| 13 | $M^*D^*_6D''_7M^*$ | 40% aq. ethanol |
| 14 | $M^{**}D^{**}_1D''_2M^{**}$ | 40% aq. acetone |
| 15 | $D^*_1D''_3$ | 40% aq. acetone |
| 16 | $D^*_2D''_2$ | 40% aq. acetone |
| 17 | $D^*_2D''_2$ | 40% aq. acetone |
| 18 | $D^*_2D''_2$ | 40% aq. acetone |
| 19 | $D^*_2D'''_2$ | 40% aq. isopropanol |
| 20 | $D^*_2D''_2$ | two-step application |

wherein:
$M = OSi(CH_3)_3$
$M^* = OSi(CH_3)_2(CH_2)_3NHSO_2C_8F_{17}$
$M^{**} = OSi(CH_3)_2(CH_2)_3NHCOC_9F_{19}$
$D = -[OSi(CH_3)_2]-$
$D^* = -[OSi(CH_3)(CH_2)_3NHSO_2C_8F_{17}]-$
$D^{**} = -[OSi(CH_3)(CH_2)_3NHCOC_9F_{19}]-$
$D'' = -[OSi(CH_3)CH_2CH(CH_3)CH_2OH]-$
$D''' = -[OSi(CH_3)(CH_2)_3OCH_2CH_2OH]-$

TABLE 2

Oil Repellency Studies for Perfluoroalkyl Silicones
Oil Repellency Ratings on a scale in which 8 is the best and 0 is the poorest by number of washes.

| Silicone No. | Number of Washes: Int.* | 5 | 10 | 15 | 20 | 25 |
|---|---|---|---|---|---|---|
| | Oil Repellency Rating | | | | | |
| Control A | 7 | 5 | 2 | 2 | 2 | 1 |
| 1 | 8 | 6 | 4 | 1 | — | — |
| 2 | 3 | 0 | — | — | — | — |
| 3 | 7 | 6 | 6 | 5 | 5 | 3 |
| 4 | 6 | 2 | 0 | — | — | — |
| 5 | 7 | 6 | 5 | 3 | 2 | 1 |
| 6 | 4 | 1 | — | — | — | — |
| 7 | 3.5 | 1 | — | — | — | — |
| 8 | 4.5 | 3 | 2 | 1 | — | — |
| 9 | 7 | 6 | 5 | 1 | 1 | — |
| 10 | 5 | 5 | 5 | 4 | 2 | 1 |
| 11 | 7 | 5 | 3 | 1.5 | 0 | — |
| 12 | 6 | 1 | — | — | — | — |
| 13 | 7 | 5 | 5 | 4 | 3 | 1 |
| 14 | 7 | 4 | 3 | 2 | 0 | — |
| 15 | 7 | 3 | 3 | 2 | 0 | — |
| 16 | 8 | 5 | 3 | 2 | 2 | 2 |
| 17 | 8 | 7 | 6 | 5 | 5 | 4** |
| 18 | 8 | 6 | 5 | 1 | — | — |
| 19 | 8 | 6 | 5 | | | |
| 20 | 8 | 6 | 6 | 5 | 5 | 5*** |

*Int. = initial rating of fabric after treatment with siloxane, but before washing.
1 rating at 26 washes
**1 rating at 35 washes
***Two-step application process

TABLE 3

Oil Repellency Studies After Simulated Dry Cleaning Using Trichlorotrifluoroethane
Oil Repellency Ratings on a scale in which 8 is the best and 0 is the poorest by number of washes.

| Silicone No. | Number of Washes: Init. | 1 dry clean | 2 dry cleans |
|---|---|---|---|
| | Oil Repellency Ratings | | |
| Control A | 8 | 1 | 0 |

TABLE 3-continued

Oil Repellency Studies After Simulated Dry Cleaning Using Trichlorotrifluoroethane
Oil Repellency Ratings on a scale in which 8 is the best and 0 is the poorest by number of washes.

| Silicone No. | Number of Washes: Init. | 1 dry clean | 2 dry cleans |
|---|---|---|---|
| | Oil Repellency Ratings | | |
| Control B | 8 | 1 | 0 |
| 17 | 8 | 6 | 4.5 |

What is claimed is:

1. A method for imparting wash durable soil and stain repellency to a fibrous substrate, which method comprises contacting a fibrous substrate with durable press resin, a catalyst, and a perfluoroalkyl hydroxyalkyl siloxane selected from the group consisting of (i) linear siloxanes having the general formula:

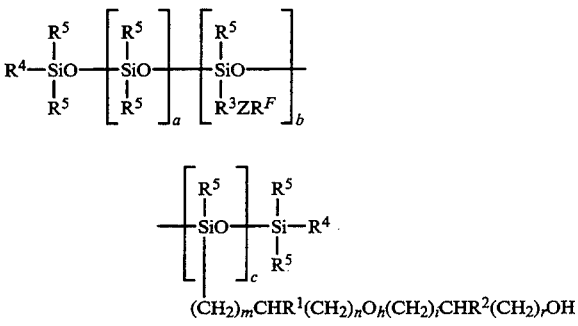

wherein a=0 to 100;

b=1 to 100;

c=1 to 100; and (ii) cyclic siloxanes having the general formula:

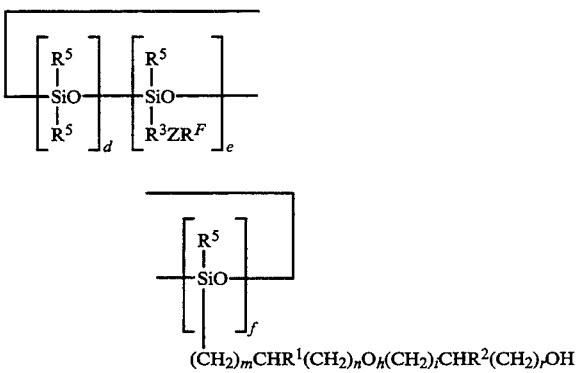

wherein d=0 to 10;

e=1 to 10;

f=1 to 10 with the proviso that d+e+f is greater than or equal to 3;

and wherein in the formulae each $R^1$ and $R^2$ is selected from the group consisting of hydrogen, hydroxy, and an alkyl group having 1 to 6 carbon atoms;

$R^3$ is selected from the group consisting of $(CH_2)_y$-CHOHCHR$^2$ and $(CH_2)_gQ_j$, wherein Q is selected from the group consisting of —NH—, —S—, and —O—; i is 0 or 1; y is 2 to 4; and g is 1 to 6;

$R^4$ is selected from the group consisting of $CH_3$, $(CH_2)_mCHR^1(CH_2)_nO_h(CH_2)_iCHR^2(CH_2)_rOH$, and $R^3ZR^F$;

Z is selected from the group consisting of —NH-CO—, —NHSO$_2$—, —O$_2$C—, —O$_3$S—, —OCH$_2$CH$_2$—, —NHCH$_2$CH$_2$—, and —CH$_2$-CHOHCH$_2$—;

m is 1 to 6;

n is 0 to 6;

$R^F$ is a perfluoro alkyl group, $C_pF_{2p+1}$, wherein p is 1 to 20;

h is 0 or 1;

i is 0 to 6;

r is 0 to 4; and each $R^5$ is independently selected from the group consisting of methyl group, ethyl group, and a phenyl group.

2. The method of claim 1 wherein in the linear siloxane, a is 0; b is 1 to 20; c is 1 to 20; $R^3$ is $(CH_2)_3$; Z is —NHSO$_2$—; $R^F$ is $C_8F_{17}$; m is 1; each $R^1$, $R^4$, and $R^5$ is a methyl group; n is 0; $R^2$ is a hydrogen, r is 0; h is 0; and i is 0.

3. The method of claim 1, wherein in the cyclic siloxane, d is 0; e is 1 to 5; f is 1 to 5; $R^3$ is $(CH_2)_3$; Z is —NHSO$_2$—; $R^F$ is $C_8F_{17}$; m is 1; each $R^1$ and $R^5$ is a methyl group; n is 0; $R^2$ is a hydrogen, r is 0; h is 0; and i is 0.

4. The method of claim 1 wherein the fibrous substrate is a natural fiber selected from the group consisting of cotton and cotton/polyester blends.

5. The method of claim 1 wherein the durable press resin

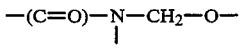

moiety.

6. The method of claim 1 wherein the catalyst is an acid catalyst selected from the group consisting of p-toluenesulfonic acid, zinc chloride, zinc tetrafluoroborate, aluminum chloride, magnesium chloride, aluminum chlorohydroxide and mixtures thereof.

7. The method of claim 1 wherein an organic solvent is employed.

8. The method of claim 7 wherein the organic solvent is selected from the group consisting of (i) a low molecular weight alcohol having 1 to 5 carbon atoms; (ii) a ketone having 1 to 6 carbon atoms and (iii) a polyalkylene glycol or glycol ether having the formula: RO(CH$_2$CHR'O )$_n$R", wherein n ranges from about 1 to 10, R' is selected from the group consisting of hydrogen and a methyl group, and each R and R" is independently selected from the group consisting of a hydrogen, an alkyl having 1 to 4 carbon atoms, and an aryl having 6 to 8 carbon atoms.

9. The method of claim 1 wherein the durable press resin is selected from the group consisting of N,N-dimethylol-4,5-dihydroxyethyleneurea, 1,3-bis-(methoxymethyl)-4,5-dihydroxy-2-imidazolidinone, 1,3-dimethylolethyleneurea, dimethylol isopropyl carbamate, and 1,3-dimethyl-4,5-dihydroxy-2-imidazolidinone.

* * * * *